US009086650B2

(12) United States Patent
Ota

(10) Patent No.: US 9,086,650 B2
(45) Date of Patent: Jul. 21, 2015

(54) DEVELOPING DEVICE AND IMAGE FORMING APPARATUS

(71) Applicant: FUJI XEROX CO., LTD., Minato-ku, Tokyo (JP)

(72) Inventor: Naoki Ota, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/932,620

(22) Filed: Jul. 1, 2013

(65) Prior Publication Data

US 2014/0105649 A1 Apr. 17, 2014

(30) Foreign Application Priority Data

Oct. 17, 2012 (JP) ..... 2012-230180

(51) Int. Cl.
*G03G 15/08* (2006.01)

(52) U.S. Cl.
CPC ..... *G03G 15/0839* (2013.01); *G03G 15/0877* (2013.01); *G03G 2215/0819* (2013.01); *G03G 2215/0827* (2013.01); *G03G 2215/0838* (2013.01)

(58) Field of Classification Search
CPC ..... G03G 15/0891
USPC ..... 399/254–256
See application file for complete search history.

(56) References Cited

U.S. PATENT DOCUMENTS

| | | | | |
|---|---|---|---|---|
| 6,882,816 | B2 * | 4/2005 | Tamai | 399/254 |
| 7,031,644 | B2 * | 4/2006 | Ikeda et al. | 399/254 |
| 7,783,233 | B2 * | 8/2010 | Iwata et al. | 399/256 |
| 8,744,320 | B2 * | 6/2014 | Mihara et al. | 399/256 |

FOREIGN PATENT DOCUMENTS

| | | | |
|---|---|---|---|
| JP | 04240677 A | * | 8/1992 |
| JP | 2010-160253 A | | 7/2010 |

* cited by examiner

*Primary Examiner* — Clayton E Laballe
*Assistant Examiner* — Leon W Rhodes, Jr.
(74) *Attorney, Agent, or Firm* — Sughrue Mion, PLLC

(57) ABSTRACT

A developing device includes: a transport/supply member disposed in a transport/supply path, formed along a developing roller, to supply a developer to the developing roller while transporting the developer from one end side toward the other end side; a transport/agitation member disposed in a transport/agitation path, inclined with respect to the transport/supply path, to agitate the developer while transporting the developer from the other end side toward the one end side; a first transport member disposed in a first transport path, connecting between the transport/supply path and the transport/agitation path on the other end side, to transport the developer from the transport/supply path to the transport/agitation path; and a second transport member disposed in a second transport path, connecting between the transport/agitation path and the transport/supply path on the one end side, to transport the developer from the transport/agitation path to the transport/supply path.

4 Claims, 5 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2012-230180 filed Oct. 17, 2012.

BACKGROUND

Technical Field

The present invention relates to a developing device and an image forming apparatus.

SUMMARY

According to an aspect of the present invention, there is provided a developing device including: a transport/supply member disposed in a transport/supply path formed along a rotary shaft of a developing roller, the transport/supply member supplying a developer containing toner and a carrier to the developing roller while transporting the developer along the transport/supply path from one end side toward the other end side in a direction of a rotational axis of the rotary shaft; a transport/agitation member disposed in a transport/agitation path formed on a side opposite to the developing roller with respect to the transport/supply path as viewed in plan with one end side of the transport/agitation path positioned vertically above the one end side of the transport/supply path and with the other end side of the transport/agitation path disposed vertically below the other end side of the transport/supply path, the transport/agitation member agitating the developer while transporting the developer along the transport/agitation path from the other end side toward the one end side; a first transport member disposed in a first transport path that connects between a lower side of the transport/supply path and an upper side of the transport/agitation path on the other end side, the first transport member transporting along the first transport path the developer fed from the transport/supply path to the first transport path to feed the developer to the transport/agitation path; and a second transport member disposed in a second transport path that connects between a lower side of the transport/agitation path and an upper side of the transport/supply path on the one end side, the second transport member transporting along the second transport path the developer fed from the transport/agitation path to the second transport path to feed the developer to the transport/supply path.

BRIEF DESCRIPTION OF THE DRAWINGS

An exemplary embodiment of the present invention will be described in detail based on the following figures, wherein.

DETAILED DESCRIPTION

Figure 1:
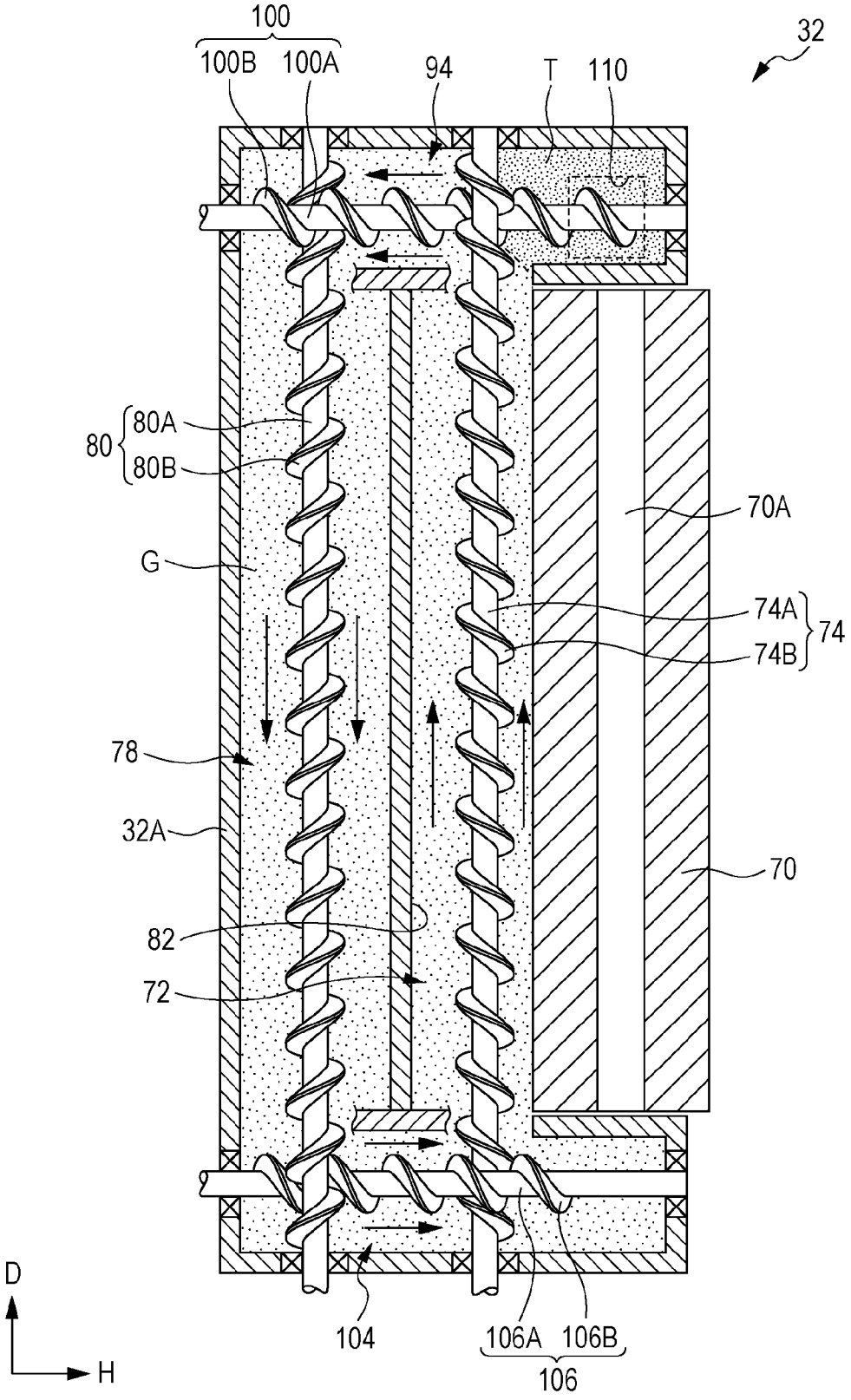
FIG. 1 is a schematic cross-sectional view showing the inside of a developing device according to an exemplary embodiment of the present invention as seen from above.

Examples of a developing device according to an exemplary embodiment of the present invention and an image forming apparatus including the developing device will be described with reference to FIGS. 1 to 5. In the drawings, the arrow V indicates the vertical direction, the arrow H indicates a horizontal direction corresponding to the apparatus width direction, and the arrow D indicates a horizontal direction corresponding to the apparatus depth direction.

(Overall Configuration)

Figure 5:
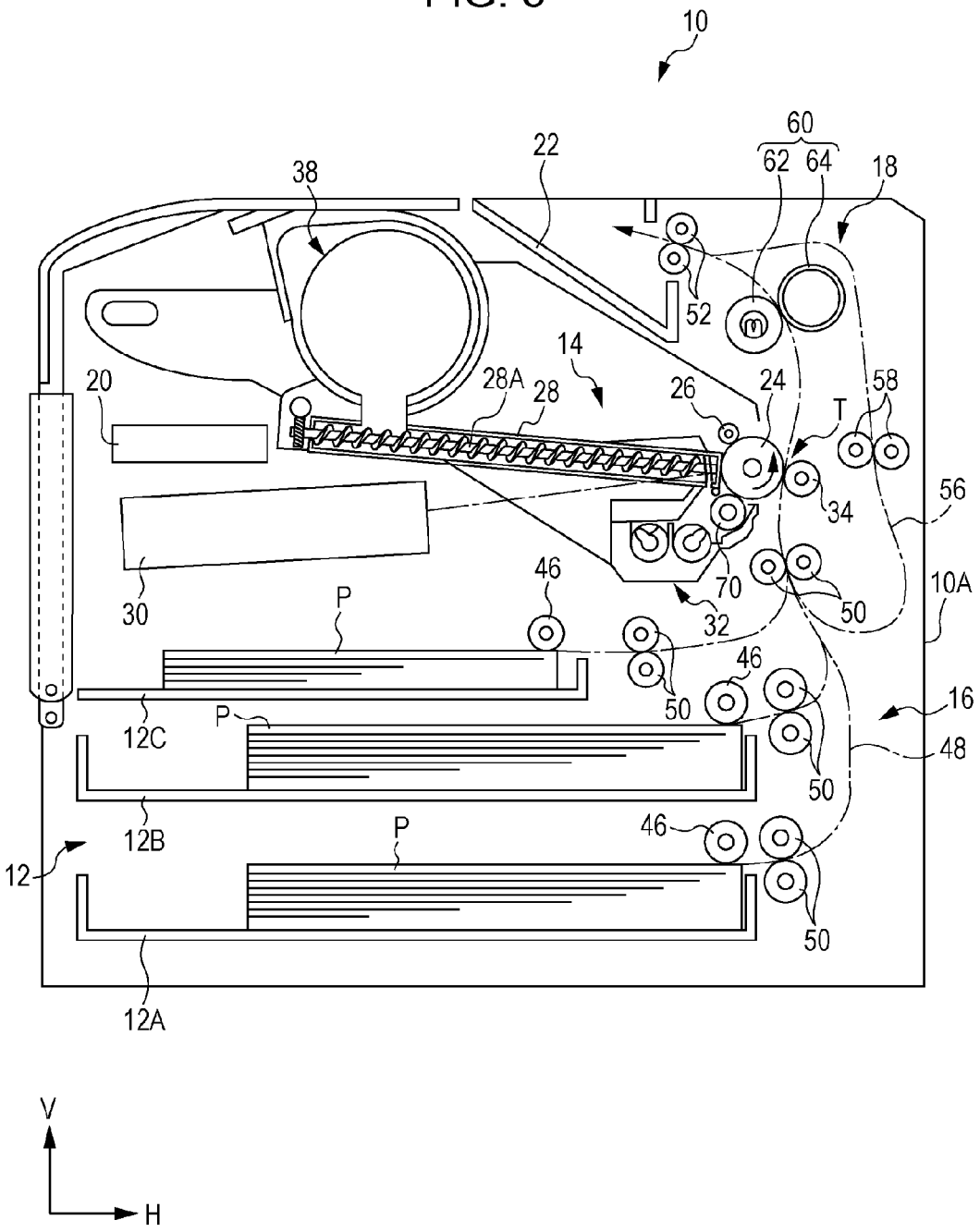
FIG. 5 shows a schematic configuration of an image forming apparatus according to the exemplary embodiment of the present invention.

As shown in FIG. 5, an image forming apparatus 10 includes an apparatus body 10A that houses therein constituent components of the image forming apparatus 10. A housing section 12, a transport section 16, an image forming section 14, a fixing section 18, and a controller 20 are provided inside the apparatus body 10A. The housing section 12 houses sheet members P serving as recording media. The transport section 16 transports the sheet member P housed in the housing section 12. The image forming section 14 forms a toner image on the sheet member P being transported. The fixing section 18 fixes the toner image formed on the sheet member P by the image forming section 14 to the sheet member P. The controller 20 controls operation of the various sections of the image forming apparatus 10.

An eject section 22 is formed in the upper portion of the apparatus body 10A. The eject section 22 ejects the sheet member P to which the image has been fixed by the fixing section 18.

[Image Forming Section]

The image forming section 14 is disposed in the apparatus body 10A around the middle in the vertical direction. The image forming section 14 includes an image holding element 24 that holds an image.

The image holding element 24 has a cylindrical shape, and rotates in one direction (counterclockwise in FIG. 5). A charging roller 26, an exposure device 30, a developing device 32, and a transfer roller 34 are disposed around the image holding element 24, and arranged in this order from the upstream side in the rotational direction of the image holding element 24. The charging roller 26 charges the image holding element 24. The exposure device 30 exposes the image holding element 24 charged by the charging roller 26 to light to form an electrostatic latent image on the image holding element 24. The developing device 32 develops the electrostatic latent image formed by the exposure device 30 using a developer G containing toner T and a carrier to obtain a black, for example, toner image. The transfer roller 34 transfers the black toner image formed on the image holding element 24 by the developing device 32 to the sheet member P.

The transfer roller 34 is disposed to face the image holding element 24, and rotates with the sheet member P interposed between the transfer roller 34 and the image holding element 24 to transport the sheet member P from below to above. The point between the transfer roller 34 and the image holding element 24 is defined as a transfer position T at which the toner image formed on the image holding element 24 is transferred to the sheet member P.

A toner cartridge 38 containing toner is disposed above the exposure device 30. The image forming section 14 further includes a transport tube 28 that transports the toner contained in the toner cartridge 38 to the developing device 32. The developing device 32 will be discussed in detail later.

[Housing Section]

The housing section 12 is disposed below the image forming section 14. The housing section 12 includes loading members 12A, 12B, and 12C arranged in the vertical direction to be loaded with the sheet members P. Each loading member 12A, 12B, 12C may be drawn toward the front side of the apparatus in the apparatus depth direction. The loading member 12A, 12B, 12C may be replenished with the sheet members P when the loading member 12A, 12B, 12C is drawn toward the front side of the apparatus.

[Transport Section]

The transport section 16 is disposed at a side of the housing section 12 and the image forming section 14. The transport section 16 includes a feed roller 46 and plural transport rollers 50. The feed roller 46 starts feeding the uppermost sheet member P stored in each loading member 12A, 12B, 12C. The transport rollers 50 transport the sheet member P fed by the feed roller 46 along a transport path 48 for the sheet member P.

The transport section 16 further includes eject rollers 52 that eject the sheet member P to which the toner image has been fixed by the fixing section 18 to the eject section 22.

The transport section 16 additionally includes transport rollers 58 that transport the sheet member P along a reverse transport path 56 in order to forward the sheet member P to one surface (front surface) of which the toner image has been fixed to the transfer position T again with the front and back sides of the sheet member P reversed.

The reverse transport path 56 is disposed opposite to the image holding element 24 with respect to the transfer roller 34. If images are to be formed on both surfaces of the sheet member P, the sheet member P to one side of which the toner image has been fixed is switched back by the eject rollers 52 to be guided to the reverse transport path 56. The sheet member P which has been guided is transported along the reverse transport path 56 by the transport rollers 58 to be turned over. Then, the sheet member P is forwarded to the transfer position T again.

[Fixing Section]

The fixing section 18 is disposed above the image forming section 14. The fixing section 18 includes a fixing device 60. The fixing device 60 includes a heating roller 62 and a pressurizing roller 64. The heating roller 62 heats the toner image transferred to the sheet member P while being rotated by a rotational force transmitted from a motor (not shown). The pressurizing roller 64 is rotationally driven through contact with the heating roller 62 to transport the sheet member P interposed between the pressurizing roller 64 and the heating roller 62.

(Function of Overall Configuration)

Next, image forming operations for forming an image on the sheet member P will be described.

In the housing section 12 and the transport section 16, the sheet member P fed from any loading member 12A, 12B, 12C by the feed roller 46 is forwarded to the transfer position T by the plural transport rollers 50.

In the image forming section 14, the image holding element 24 is charged by the charging roller 26, and thereafter exposed to light by the exposure device 30 so that an electrostatic latent image is formed on the image holding element 24. The electrostatic latent image is developed by the developing device 32 so that a black toner image is formed on the image holding element 24. The black toner image is transferred by the transfer roller 34 to the sheet member P which has been transferred to the transfer position T.

The sheet member P to which the toner image has been transferred is transported to the fixing device 60 so that the toner image which has been transferred to the sheet member P is fixed by the fixing device 60 to the sheet member P. In the case where an image is to be formed only on one surface of the sheet member P, the sheet member P is ejected to the eject section 22 by the eject rollers 52 after the toner image is fixed to the sheet member P.

In the case where images are to be formed on both surfaces of the sheet member P, in contrast, the sheet member P is switched back by the eject rollers 52 to be forwarded to the reverse transport path 56 after the toner image is fixed to one surface (front surface) of the sheet member P. The sheet member P is turned over when the transport rollers 58 transport the sheet member P along the reverse transport path 56. Then, the sheet member P is forwarded from the reverse transport path 56 to the transfer position T again. A toner image is formed on the back surface of the sheet member P, on which no toner image has been formed, in the same manner as on its front surface. The sheet member P is ejected to the eject section 22 by the eject rollers 52. A sequence of image forming operations is thus accomplished.

(Construction of Developing Device)

Next, the developing device 32 will be described.

The developing device 32 includes a developing roller 70 disposed along the image holding element 24. The developing roller 70 rotates with the developer G held on its outer peripheral surface and supplies the toner T to the image holding element 24 on which an electrostatic latent image has been formed to develop the electrostatic latent image as a toner image.

[Transport/Supply Path]

When the inside of the developing device 32 is seen from above (viewed in plan), as shown in FIG. 1, a transport/supply path 72 is formed inside a housing 32A of the developing device 32 to extend along a rotary shaft 70A of the developing roller 70. The transport/supply path 72 allows the developer G to be transported while contacting the outer peripheral surface of the developing roller 70A.

Further, a transport/supply auger 74 serving as an example of a transport/supply member is disposed in the transport/supply path 72 to extend in the direction of the rotational axis of the rotary shaft 70A (hereinafter simply referred to as "roller axis direction"). The transport/supply auger 74 includes a columnar shaft portion 74A and a helical blade portion 74B integrally formed on the outer peripheral surface of the shaft portion 74A. The shaft portion 74A is rotatably supported by the housing 32A. One end side (lower side in FIG. 1) of the shaft portion 74A in the roller axis direction projects out of the housing 32A. A gear member (not shown) is attached to the one end side of the shaft portion 74A projecting out of the housing 32A so that a rotational force is transmitted from a motor (not shown) to the shaft portion 74A.

The transport/supply auger 74 rotates to agitate the developer G and supply the developer G to the developing roller 70 while transporting the developer G along the transport/supply path 72 from the one end side toward the other end side (upper side in FIG. 1).

In the exemplary embodiment, the roller axis direction and the apparatus depth direction (direction of the arrow D) match each other when the developing device 32 is attached to the apparatus body 10A.

[Transport/Agitation Path]

Further, a transport/agitation path 78 is formed in the housing 32A to extend in the roller axis direction as viewed in plan, on the side opposite to the developing roller 70 with respect to the transport/supply path 72 as viewed in plan. One end side of the transport/agitation path 78 in the roller axis direction is disposed vertically above the one end side of the transport/supply path 72 (see FIG. 4), and the other end side of the transport/agitation path 78 in the roller axis direction is disposed vertically below the other end side of the transport/supply path 72.

Figure 2:
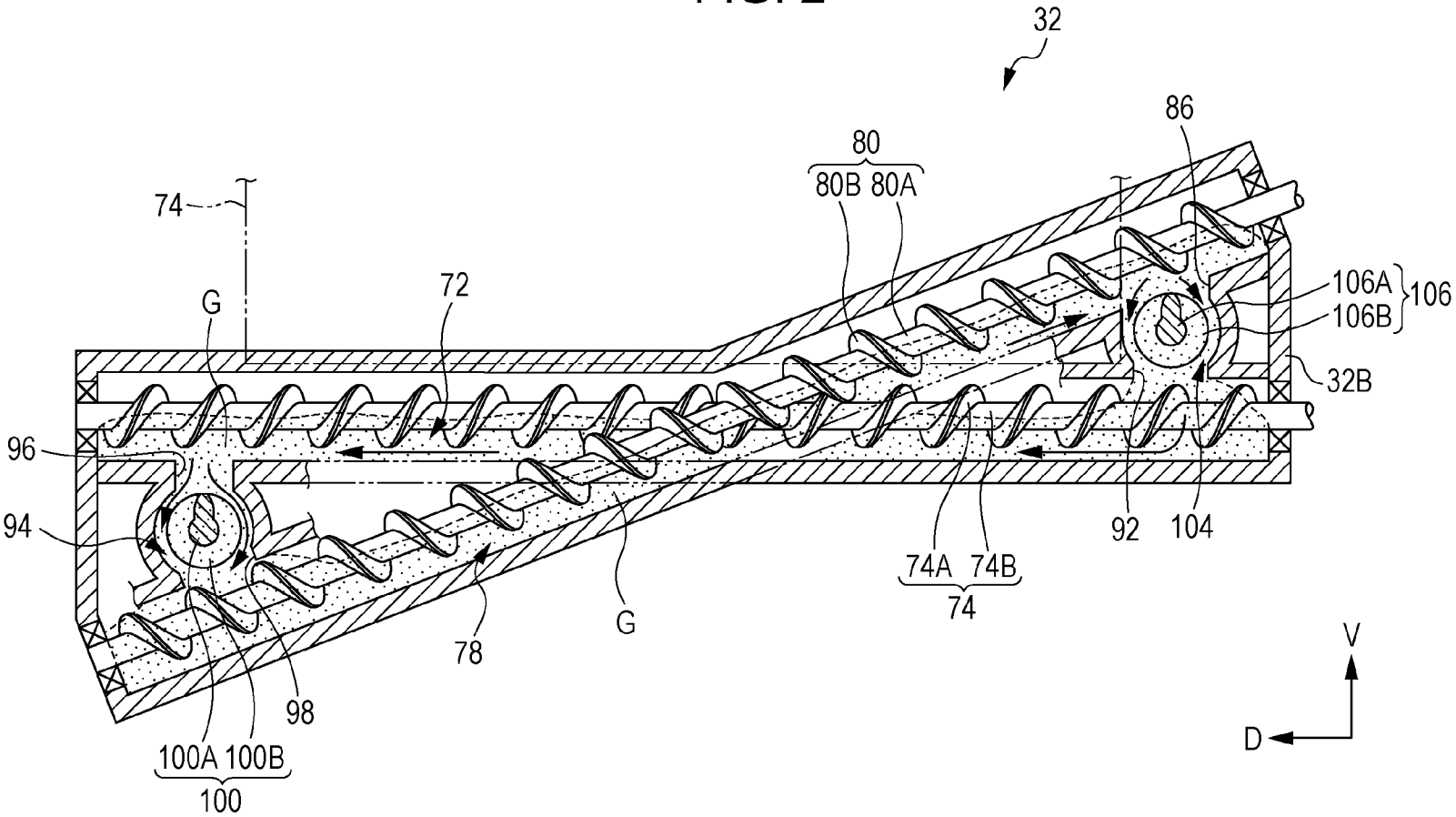
FIG. 2 is a schematic cross-sectional view showing the inside of the developing device according to the exemplary embodiment of the present invention as seen from the front.

That is, when the inside of the developing device 32 is seen in a horizontal direction that is orthogonal to the roller axis direction (hereinafter simply referred to as "roller orthogonal direction"), as shown in FIG. 2, the transport/agitation path 78 is inclined with respect to the transport/supply path 72, and the transport/agitation path 78 and the transport/supply path 72 cross each other around the middle in the roller axis direction.

In the exemplary embodiment, the roller orthogonal direction and the apparatus width direction (direction of the arrow H) match each other when the developing device 32 is attached to the apparatus body 10A.

Further, as shown in FIG. 1, a partition wall 82 is formed between the transport/agitation path 78 and the transport/supply path 72 to partition the transport/agitation path 78 and the transport/supply path 72 except on the one end side and the other end side in the roller axis direction.

Further, as shown in FIGS. 1 and 2, a transport/agitation auger 80 serving as an example of a transport/agitation member is disposed in the transport/agitation path 78 to extend along the transport/agitation path 78. The transport/supply auger 80 includes a columnar shaft portion 80A and a helical blade portion 80B integrally formed on the outer peripheral surface of the shaft portion 80A. The shaft portion 80A is rotatably supported by the housing 32A. One end side (lower side in FIG. 1) of the shaft portion 80A in the roller axis direction projects out of the housing 32A. A gear member (not shown) is attached to the one end side of the shaft portion 80A projecting out of the housing 32A so that a rotational force is transmitted from a motor (not shown) to the shaft portion 80A.

The transport/agitation auger 80 rotates to agitate the developer G while transporting the developer G along the transport/agitation path 78 from the other end side toward the one end side in the roller axis direction.

[First Transport Path]

Figure 3:
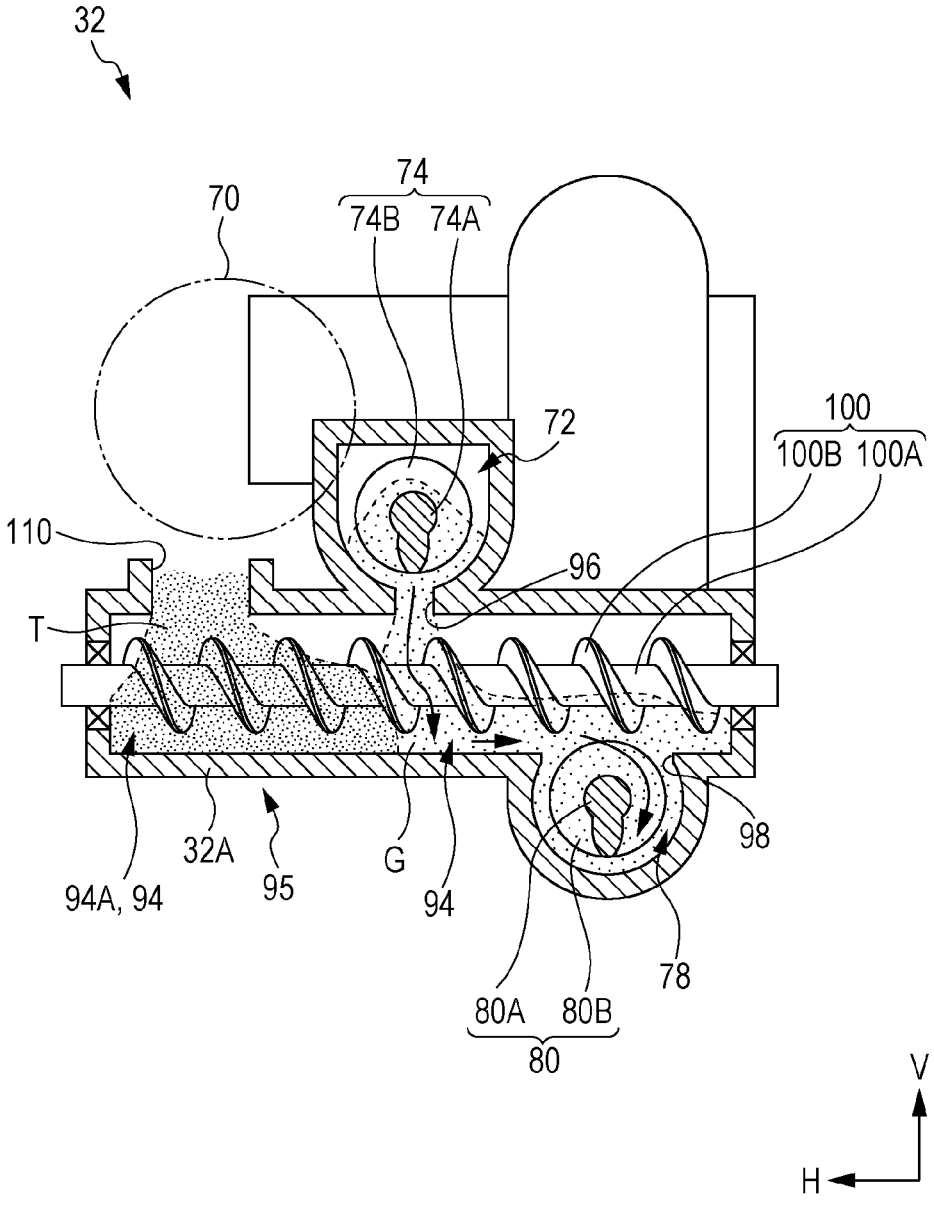
FIG. 3 is a cross-sectional view showing the inside of the developing device according to the exemplary embodiment of the present invention as seen from a side.

As shown in FIGS. 1 and 3, a first transport path 94 is formed in the housing 32A to connect between the other end side of the transport/supply path 72 in the roller axis direction and the other end side of the transport/agitation path 78 in the roller axis direction.

On the other end side in the roller axis direction, as shown in FIG. 3, the first transport path 94 is formed to extend in the roller orthogonal direction, and connects between the lower side of the transport/supply path 72 and the upper side of the transport/agitation path 78.

Specifically, an open hole 96 leading to the first transport path 94 is formed in the lower surface of the transport/supply path 72 on the other end side in the roller axis direction, and an open hole 98 leading to the first transport path 94 is formed in the upper surface of the transport/agitation path 78 on the other end side in the roller axis direction. In this way, the other end side of the transport/supply path 72 in the roller axis direction and the other end side of the transport/agitation path 78 in the roller axis direction are connected to each other through the open hole 96, the first transport path 94, and the open hole 98.

Further, an extended portion 94A is formed in the first transport path 94 to extend toward the side opposite to the transport/agitation path 80 with respect to the transport/supply path 72. A toner supply port 110 is formed above the extended portion 94A to supply the toner T to the first transport path 94. The distal end portion of the transport tube 28 (see FIG. 5) which transports the toner T contained in the toner cartridge 38 is coupled to the toner supply port 110. The extended portion 94A and the toner supply port 110 form a toner supply section 95 that supplies the toner T to the first transport path 94.

Further, a first transport auger 100 serving as an example of a first transport member is disposed in the first transport path 94 to extend along the first transport path 94. The first transport auger 100 includes a columnar shaft portion 100A and a helical blade portion 100B integrally formed on the outer peripheral surface of the shaft portion 100A. The shaft portion 100A is rotatably supported by the housing 32A. One end side (right side in FIG. 3) of the shaft portion 100A in the roller orthogonal direction projects out of the housing 32A. A gear member (not shown) is attached to the one end side of the shaft portion 100A projecting out of the housing 32A so that a rotational force is transmitted from a motor (not shown) to the shaft portion 100A.

The first transport auger 100 rotates to agitate the developer G while transporting the developer G along the first transport path 94 from the other end side (left side in FIG. 3) toward the one end side in the roller orthogonal direction.

[Second Transport Path]

Figure 4:
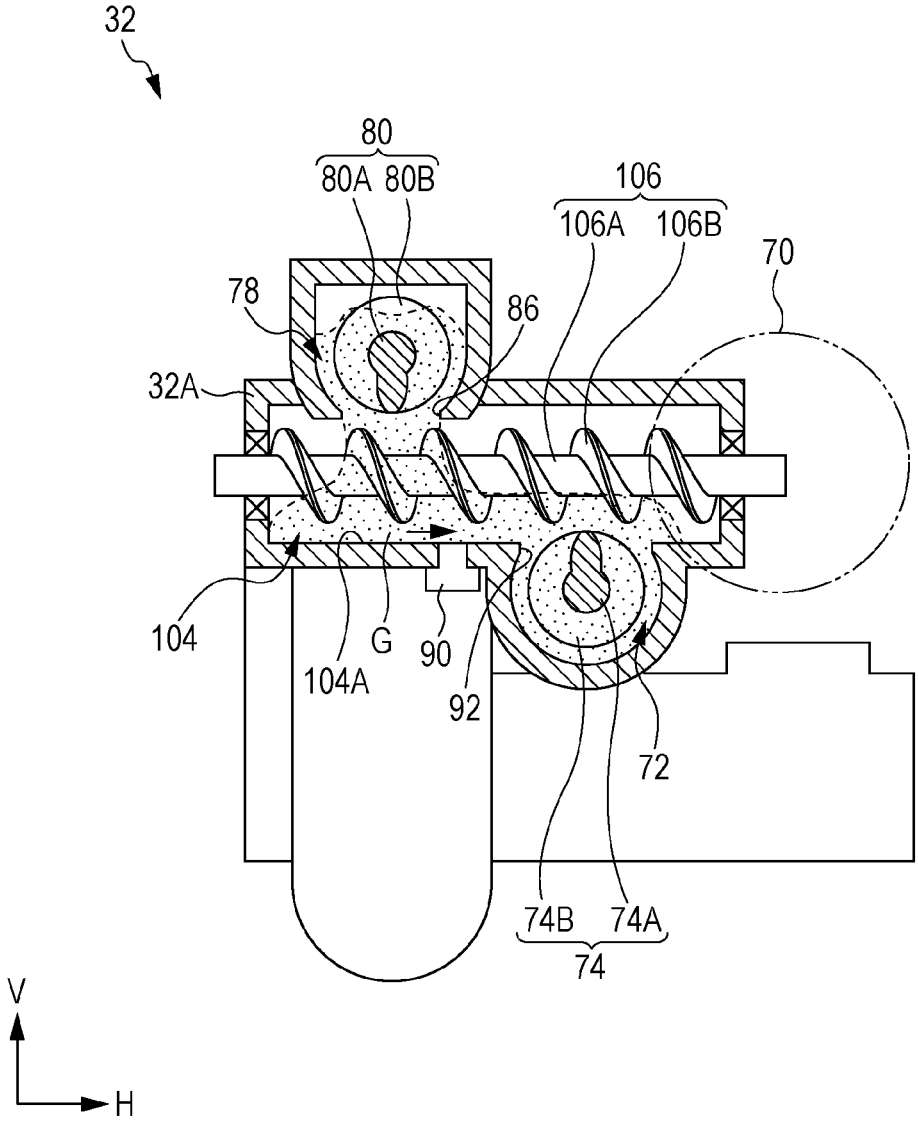
FIG. 4 is a cross-sectional view showing the inside of the developing device according to the exemplary embodiment of the present invention as seen from a side.

As shown in FIGS. 1 and 4, a second transport path 104 is formed in the housing 32A to connect between the one end side of the transport/agitation path 78 in the roller axis direction and the one end side of the transport/supply path 72 in the roller axis direction.

On the one end side in the roller axis direction, as shown in FIG. 4, the second transport path 104 is formed to extend in the roller orthogonal direction, and connects between the lower side of the transport/agitation path 78 and the upper side of the transport/supply path 72.

Specifically, an open hole 86 leading to the second transport path 104 is formed in the lower surface of the transport/agitation path 78 on the one end side in the roller axis direction, and an open hole 92 leading to the second transport path 104 is formed in the upper surface of the transport/supply path 72 on the one end side in the roller axis direction. In this way, the one end side of the transport/agitation path 78 in the roller axis direction and the one end side of the transport/supply path 72 in the roller axis direction are connected to each other through the open hole 86, the second transport path 104, and the open hole 92.

Further, a second transport auger 106 serving as an example of a second transport member is disposed in the second transport path 104 to extend along the second transport path 104. The second transport auger 106 includes a columnar shaft portion 106A and a helical blade portion 106B integrally formed on the outer peripheral surface of the shaft portion 106A. The shaft portion 106A is rotatably supported by the housing 32A. One end side (left side in FIG. 4) of the shaft portion 106A in the roller orthogonal direction projects out of the housing 32A. A gear member (not shown) is attached to the one end side of the shaft portion 106A projecting out of the housing 32A so that a rotational force is transmitted from a motor (not shown) to the shaft portion 106A.

The second transport auger 106 rotates to agitate the developer G while transporting the developer G along the second transport path 104 from the one end side toward the other end side in the roller orthogonal direction.

Further, a toner densitometer 90 is disposed in a bottom plate 104A forming the second transport path 104 to measure the toner density (ratio of the amount of the toner to the amount of the carrier) of the developer G transported by the second transport auger 106.

In the case where the result of the measurement performed by the toner densitometer 90 indicates that the toner density is less than a prescribed value, the controller 20 (see FIG. 5) rotates a transport auger 28A (see FIG. 5) provided in the transport tube 28 to supply the toner T from the toner supply port 110 (see FIG. 3) to the developing device 32.

(Function of Developing Device)

Next, the function of the developing device 32 will be described.

As shown in FIG. 1, the developer G contained in the housing 32A of the developing device 32 is transported by the transport/supply auger 74, the first transport auger 100, the transport/agitation auger 80, and the second transport auger 106 to circulate in the direction of the arrows in the drawing through the transport/supply path 72, the first transport path 94, the transport/agitation path 78, and the second transport path 104.

Specifically, the developer G contained in the transport/supply path 72 is agitated by the transport/supply auger 74 while being transported along the transport/supply path 72 from the one end side toward the other end side in the roller axis direction. In the course of being transported, the developer G is supplied to the developing roller 70. The developer G transported to the other end side in the roller axis direction by the transport/supply auger 74 is caused by the gravitational force to fall down through the open hole 96 to be fed into the first transport path 94.

The developer G fed into the first transport path 94 is agitated by the first transport auger 100 while being transported along the first transport path 94 from the other end side toward the one end side in the roller orthogonal direction. The developer G transported to the one end side in the roller orthogonal direction by the first transport auger 100 is caused by the gravitational force to fall down through the open hole 98 to be fed into the transport/agitation path 78.

The developer G fed into the transport/agitation path 78 is agitated by the transport/agitation auger 80 while being transported along the transport/agitation path 78 from the other end side toward the one end side in the roller axis direction as shown in FIG. 2. The developer G transported to the one end side in the roller axis direction by the transport/agitation auger 80 is caused by the gravitational force to fall down through the open hole 86 to be fed into the second transport path 104.

The developer G fed into the second transport path 104 is agitated by the second transport auger 106 while being transported along the second transport path 104 from the one end side toward the other end side in the roller orthogonal direction as shown in FIG. 4. The developer G transported to the other end side in the roller orthogonal direction by the second transport auger 106 is caused by the gravitational force to fall down through the open hole 92 to be fed into the transport/supply path 72.

The developer G fed into the transport/supply path 72 is agitated by the transport/supply auger 74 while being transported along the transport/supply path 72 from the one end side toward the other end side in the roller axis direction as discussed earlier as shown in FIG. 1. In the course of being transported, the developer G is supplied to the developing roller 70.

By repeating the processes described above, the developer G contained in the housing 32A is transported by the transport/supply auger 74, the first transport auger 100, the transport/agitation auger 80, and the second transport auger 106 to circulate in the direction of the arrows in the drawing through the transport/supply path 72, the first transport path 94, the transport/agitation path 78, and the second transport path 104.

As shown in FIG. 4, the toner densitometer 90 disposed in the bottom plate 104A of the second transport path 104 measures the toner density of the developer G transported by the second transport auger 106.

In the case where the result of the measurement performed by the toner densitometer 90 indicates that the toner density is less than a prescribed value, the controller 20 (see FIG. 5) rotates the transport auger 28A (see FIG. 5) provided in the transport tube 28 to supply the toner T from the toner supply port 110 (see FIG. 3) to the developing device 32.

As has been described above, when the developer G is fed from the transport/supply auger 74 disposed in the transport/supply path 72 to the transport/agitation auger 80 disposed in the transport/agitation path 78, the developer G is once fed from the transport/supply path 72 into the first transport path 94, and then transported by the first transport auger 100 to be fed into the transport/agitation path 78.

With the developer G thus transported by the first transport auger 100, the developer G is fed from the transport/supply auger 74 in the transport/supply path 72 to the transport/agitation auger 80 in the transport/agitation path 78.

Similarly, with the developer G transported by the second transport auger 106 disposed in the second transport path 104, the developer G is fed from the transport/agitation auger 80 in the transport/agitation path 78 to the transport/supply auger 74 in the transport/supply path 72.

The toner supply port 110 is formed in the extended portion 94A of the first transport path 94. Therefore, the toner T supplied from the toner supply port 110 is fed to the transport/supply auger 74 via the second transport auger 106 after being agitated by the transport/agitation auger 80. Thus, the supplied toner T has been agitated with the already existing developer G when the toner T is fed to the transport/supply auger 74. That is, the developer G obtained by agitating the supplied toner T and the already existing developer G together is supplied from the transport/supply auger 74 to the developing roller 70.

The developer G obtained by agitating the supplied toner T and the already existing developer G together is supplied from the transport/supply auger 74 to the developing roller 70.

The toner densitometer 90 is disposed in the bottom plate 104A forming the second transport path 104 to measure the toner density of the developer G. That is, the toner density of the developer G obtained after the transport/agitation auger 80 agitates the supplied toner T and the already existing developer G is measured.

While a specific exemplary embodiment of the present invention has been described in detail above, the present invention is not limited to such an exemplary embodiment. It is apparent to those skilled in the art that a variety of other exemplary embodiments may fall within the scope of the present invention. For example, the first transport path 94 and the second transport path 104 are formed to extend in the roller orthogonal direction (horizontal direction) in the embodiment described above. However, the first transport path 94 and the second transport path 104 may be inclined with respect to the horizontal direction.

What is claimed is:

1. A developing device comprising:

a transport/supply member disposed in a transport/supply path formed along a rotary shaft of a developing roller, the transport/supply member supplying a developer containing toner and a carrier to the developing roller while transporting the developer along the transport/supply path from one end side toward the other end side in a direction of a rotational axis of the rotary shaft;

a transport/agitation member disposed in a transport/agitation path formed on a side opposite to the developing roller with respect to the transport/supply path as viewed in plan with one end side of the transport/agitation path positioned vertically above the one end side of the transport/supply path and with the other end side of the transport/agitation path disposed vertically below the other end side of the transport/supply path, the transport/agitation member agitating the developer while transporting the developer along the transport/agitation path from the other end side toward the one end side;

a first transport member disposed in a first transport path that connects between a lower side of the transport/supply path and an upper side of the transport/agitation path on the other end side, the first transport member transporting along the first transport path the developer fed from the transport/supply path to the first transport path to feed the developer to the transport/agitation path; and a second transport member disposed in a second transport path that connects between a lower side of the transport/agitation path and an upper side of the transport/supply path on the one end side, the second transport member transporting along the second transport path the developer fed from the transport/agitation path to the second transport path to feed the developer to the transport/supply path, wherein the first transport member and the second transport member are disposed such that a rotation axis of the first transport member and the second member lie in a horizontal direction.

2. The developing device according to claim 1, further comprising:

a toner supply section that supplies the toner to the first transport path.

3. The developing device according to claim 1, further comprising:

a toner densitometer that measures a toner density of the developer transported along the second transport path by the second transport member.

4. An image forming apparatus comprising:

an image holding element on which an electrostatic latent image is to be formed; and the developing device according to claim 1 that develops the electrostatic latent image formed on the image holding element as a toner image.

* * * * *